US008109406B2

(12) United States Patent
Chang

(10) Patent No.: US 8,109,406 B2
(45) Date of Patent: Feb. 7, 2012

(54) BEVERAGE CONTAINER CONSTRUCTION

(76) Inventor: Charles Chang, Wayne, NJ (US)

( * ) Notice: Subject to any disclaimer, the term of this patent is extended or adjusted under 35 U.S.C. 154(b) by 1324 days.

(21) Appl. No.: 11/713,860

(22) Filed: Mar. 5, 2007

(65) Prior Publication Data

US 2008/0099480 A1 May 1, 2008

Related U.S. Application Data

(60) Provisional application No. 60/854,294, filed on Oct. 26, 2006.

(51) Int. Cl.
*B65D 17/34* (2006.01)

(52) U.S. Cl. ..... 220/272; 220/269; 220/270; 220/906

(58) Field of Classification Search ..... 220/269, 220/270, 272, 906, 254.1, 271, 276
See application file for complete search history.

(56) References Cited

U.S. PATENT DOCUMENTS

| | | | | |
|---|---|---|---|---|
| 3,795,340 | A | 3/1974 | Hougen et al. | |
| 3,858,754 | A | 1/1975 | Patarini et al. | |
| 3,934,750 | A | 1/1976 | Herbst | |
| 3,967,754 | A | 7/1976 | Ostrem | |
| 4,014,455 | A | 3/1977 | LaCroce | |
| 4,550,851 | A | 11/1985 | Garrett et al. | |
| 4,915,246 | A | 4/1990 | Nosaka et al. | |
| 5,405,039 | A | 4/1995 | Komura | |
| 5,555,992 | A | 9/1996 | Sedgeley | |
| 5,655,678 | A | 8/1997 | Kobayashi | |
| 5,711,448 | A | 1/1998 | Clarke, III | |
| 5,813,559 | A * | 9/1998 | Cho | 220/258.2 |
| 5,934,497 | A * | 8/1999 | Chang et al. | 220/269 |
| 5,964,366 | A | 10/1999 | Hurst et al. | |
| 6,260,728 | B1 | 7/2001 | Turner et al. | |
| 6,375,029 | B2 * | 4/2002 | Anthony et al. | 220/271 |
| 6,427,861 | B1 * | 8/2002 | Cho | 220/269 |
| 6,779,675 | B2 * | 8/2004 | Cousseau | 220/270 |
| 7,137,524 | B2 * | 11/2006 | Nomula | 220/269 |
| 7,665,623 | B2 * | 2/2010 | Emmerzaal | 220/269 |
| 2002/0088803 | A1 * | 7/2002 | Emmerzaal | 220/269 |
| 2002/0139800 | A1 | 10/2002 | Hwang et al. | |
| 2003/0098306 | A1 * | 5/2003 | Cho | 220/269 |
| 2003/0132230 | A1 * | 7/2003 | Gitelman et al. | 220/269 |
| 2004/0056032 | A1 | 3/2004 | Vaughan | |
| 2005/0006389 | A1 * | 1/2005 | Emmerzaal | 220/269 |
| 2005/0017005 | A1 * | 1/2005 | Nomula | 220/254.1 |
| 2006/0175332 | A1 * | 8/2006 | Serra | 220/269 |

(Continued)

*Primary Examiner* — Anthony Stashick
*Assistant Examiner* — Christopher McKinley
(74) *Attorney, Agent, or Firm* — K. Gibner Lehmann

(57) ABSTRACT

A beverage container includes a can body having a side wall, a neck portion of reduced diameter, a closure lid and an anchor structure on the closure lid. The anchor structure is offset with respect to the center of the lid. A pull tab has a mounting hole which fits onto the anchor structure. One end of the pull tab has a grip handle, and the other end has a puncturing nose. The pull tab is turnable on the anchor structure, and thus also turnable with respect to the closure lid. The pull tab is of a length whereby it normally just fits between the opposite locations of a peripheral groove on the closure lid. The pull tab can be manually turned from a first position overlying the closure lid, to a second position wherein it overhangs one part of the peripheral groove. The construction thus provides an extended handle length to permit the user to more easily grasp and raise the pull tab, and open the container, for use. The pull tab remains captive with the open container, for anti-litter and recycling purposes.

1 Claim, 7 Drawing Sheets

U.S. PATENT DOCUMENTS

2006/0201944 A1* 9/2006 Shibasaka et al. ..... 220/254.1
2006/0237459 A1* 10/2006 LePera ..... 220/269
2007/0029324 A1* 2/2007 Watson et al. ..... 220/269
2007/0039961 A1* 2/2007 McEldowney et al. ..... 220/269
2007/0181526 A1* 8/2007 Frishman ..... 215/257
2008/0000905 A1* 1/2008 Omura ..... 220/269

* cited by examiner

BEVERAGE CONTAINER CONSTRUCTION

CROSS REFERENCES TO RELATED APPLICATION

The present application claims priority of U.S. Provisional Parent Application Ser. No. 60/854,294, having a filing date of Oct. 26, 2006, in the name of Charles Chang, and the said Provisional application being incorporated herein in its entirety, by specific reference thereto.

STATEMENT AS TO RIGHTS TO INVENTIONS MADE UNDER FEDERALLY SPONSORED RESEARCH AND DEVELOPMENT

Research and development of the present invention and application have not been Federally-sponsored, and no rights are given under any Federal program.

BACKGROUND OF THE INVENTION

Field of the Invention

This invention relates generally to aluminum cans of the type commonly used to dispense beverages for consumption, including beer, soda, syrups and the like. More particularly the invention incorporates improvements to container structures of the type having pull tabs that are held captive following opening of the container, to minimize litter and effect automatic re-cycling of the captive pull tab with the can, per se.

DESCRIPTION OF THE RELATED ART INCLUDING INFORMATION DISCLOSED UNDER 37 CFR 1.97-1.99

Two-piece aluminum beverage cans have experienced many changes over the last several decades, aimed at reduction of cost through improved manufacturing methods, reduction in the actual quantity of aluminum that is required for a particular can volume, and more specifically improvements relating to retaining all parts of the opening mechanism with the remainder of the can and lid, for environmental reasons. Not only has this reduced the litter arising from loose 'pop tops'; in addition, the former 'pop tops' are now held captive in the can so that when recycling occurs, all parts of the can, including its opening mechanism which was also aluminum, were recycled together. Elimination of 'pop tops' has thus been achievable throughout most of the countries of the world. An early attempt at reducing the amount of aluminum required for a particular can involved a slight reduction in the size of the can lid. Previously the lid was generally of the same diameter as that of the can body. Now, slightly tapered necks are provided on many cans, by a process known in the technology as 'necking'. This was done after the can has been extruded, but prior to crimping of the lid onto the can itself.

While this saved some aluminum, the 'necking' process currently employed as of the present date, involves a multi-step process of drawing the neck inwardly in small steps. This has been necessary because care had to be exercised in bending the walls of the can, especially since tolerances involved with the extrusion made the can walls somewhat susceptible to inadvertent rupture from the possibility that the multi-step 'necking' procedure was not precisely carried out.

The savings which occurred from the can neck reduction described above were enormous. The annular usage of the 2-piece aluminum can in the United States is currently around 200 billion pieces. A saving of $1.00 per thousand pieces converts to an annual saving of approximately $200 million.

The current effort to reduce the lid size is currently approaching the range of glass bottle neck size.

FIGS. 1 and 2 illustrate a typical can, incorporating the neck reduction noted above. Difficulties have arisen from the mere attempt to make a smaller lid size, as will be explained further hereinbelow.

Meanwhile, the following patents are hereby made of record and are believed to constitute a sampling of existing prior art in the field to which the invention relates:

U.S. Pat. No. 3,967,754
U.S. Pat. No. 3,795,340
U.S. Pat. No. 3,858,754
U.S. Pat. No. 4,014,455
U.S. Pat. No. 4,550,851
U. S. Patent Application Publication Nos.:
2002/0139800
2004/0056032

U.S. Pat. No. 3,967,754 discloses a can lid construction having a pull tab which has an end portion that normally interlocks with an upstanding abutment on the can lid. The object is to prevent inadvertent turning of the tab to a position wherein it would have portions extending above the plane of the can lid bead, and possibly be subjected to impact as the can ran through automatic assembly equipment. The effect of this possible inadvertent touching of an overly high pull tab with parts of automated machinery, has branded the name of such cans as, being "rockers".

U.S. Pat. No. 3,795,340 relates to a can lid arrangement wherein the pull tab is normally stored in a partially swiveled position. The nose of the tab, which is the part that effects the rupturing of the lid along a score line thereof, is thereby held in a position away from the starting end of the score line, and thus cannot inadvertently rupture the can lid and open the can. To open the can, the tab is first lifted slightly and swiveled to the position of FIG. 2 of the patent. The nose is then aligned with the beginning of the score line of the lid, and can thus be used in the usual manner to open the can.

U.S. Pat. No. 3,858,754 shows still another arrangement of can construction, incorporating a pull tab and a convex shaped can lid incorporating a transverse crease (L), which the inventors allege, reduce the tendency for the lid to bulge under increased pressures which are apt to occur during handling or inadvertent shaking of filled cans. The tab is located so that all parts are disposed below the plane of the lid bead.

U.S. Pat. No. 3,934,750 illustrates and describes a can lid structure incorporating a domed closure piece which is initially integral with the remainder of the can lid, and a pull tab disposed so as to force the dome downwardly into the container when the tab is initially lifted. A metal hinge part between the dome and the tab prevents inadvertent separation of the tab from the can, for environmental and safety concerns.

U.S. Pat. No. 4,014,455 discloses a lid construction incorporating a pull tab, and one or more upstanding posts on the lid surface, which occupy the hole in the pull tab and prevent inadvertent lifting of the tab and opening of the can during storage, shipping or other occasions involving handling. The posts can be by-passed by a gentle pull of the user, to open the can in the usual manner.

U.S. Pat. No. 4,550,851 relates to a can lid containing a pull tab having an elongate groove, the tab being carried on the usual rivet in the lid. The rivet is centered on the lid, and the groove permits limited sliding, or swiveling movement of a pull tab. The tab can thus be shifted between a first, closed position wherein it is prevented from contacting the break or score line of the lid, to a second, use position. Under the latter circumstance, the nose of the tab is brought over the rupturable area of the can lid. Forcible raising of the tab thereby effects opening of the can.

U. S. Patent Application Publication No. 2004/0056032 involves a beverage container construction purportedly incorporating improvements relating to easier opening by virtue of the requirement of less force applied to the pull tab, and improved resistance to inadvertent opening, during handling or shipping. The pull tab has a round opening for engagement by the fingers, and also features an asymmetrical leg configuration wherein one leg is longer than the other, and wherein this longer leg is arranged to engage the start portion of the score line in the can lid.

Finally, U. S. Patent Application Publication No. 2002/0139800 relates to a can construction and lid incorporating a widened pull tab, so located with respect to the score areas of the lid, as to enable the user to break open two score holes with the single tab. The larger of the score holes is intended to facilitate drinking of the beverage contained in the can, whereas the smaller of the holes is an 'air' return passage to avoid momentary vacuums inside the can as the contents flow out.

A typical, currently-available beverage can arrangement is shown in FIGS. 1 and 2. The can side wall is designated 202, the lid per se is indicated 301, and the outermost rim or outer periphery of the can lid is indicated by the numeral 101. This frequently takes the form of a crimping connection or bead, as is well known in the field.

The prior art can lid 301 has an area of weakness defined by a score line 304, together with a pull tab 302 which has a free end 305 and a front or puncturing nose portion 306. The pull tab 302 is fastened to the can lid by means of an anchor or rivet 303 disposed in the center of the lid 301. When the end 305 of the pull tab 302 is lifted by the fingers of the consumer, the nose portion 306 of the pull tab 302 punctures and depresses the area of weakness defined by the score line 304, thus producing the usual dispensing opening.

In this prior art design, there is always a gap L4 (FIG. 1) between the end 305 of the pull tab 302 and the inside of the rim 101 of the can lid 301, to enable the consumer to place a finger nail under the end 305 of the pull tab 302 and lift it up. Referring to FIG. 1, the current design of the lid requires a minimum inside diameter for the can rim 101 to be the total of the distances $L_1+L_2+L_3+L_4$. Because the pull tab 302 is already quite short, and the room for the puncture area defined by the score line 304 is already considered marginal, efforts to further reduce the overall lid size have been restricted by those limitations. The effort to significantly reduce the amount of aluminum that was required has thus been largely for naught.

SUMMARY OF THE INVENTION

Accordingly it is an object of the present invention to provide a novel and improved beverage can construction which features a significantly reduced neck/lid surface which results in an important savings in aluminum and consequent reduction in overall cost.

A related object of the invention is to provide an improved beverage can construction as above set forth, wherein existing capping equipment can be utilized to assemble the can lids to the can, thus minimizing the need for changing existing fixtures or assembly equipment.

Still another object of the invention is to provide an improved beverage can construction in accordance with the foregoing, which is easy for the consumer to use by virtue of a reduction in the absolute pull force required to effect initial opening of the can construction.

A still further object of the invention is to provide an improved beverage can construction as described above, which is environmentally friendly by virtue of the arrangement wherein the opening structure is held captive with the remainder of the can after the latter is opened. Thus, not only is there eliminated the hazard presented by scattered 'pop' top closures lying on sidewalks and streets, but also, the aluminum represented by the opening structure is capable of being recycled automatically with the remainder of the can.

Yet another object of the invention is to provide an improved beverage can construction of the kind characterized above, which features convenient handling by automated equipment, as a consequence of its opening structure being essentially entirely below the plane of the periphery of the lid, thereby eliminating the problem noted previously with cans that were characterized as 'rockers'.

Still a further object of the invention is to provide an improved beverage can construction as above described, which can accommodate container blanks having a stepped or graduated neck configuration, thus saving on the amount of aluminum that is required for dispensing a given volume of a particular beverage.

The above objects are provided by a beverage container, comprising in combination a tubular can body having a neck portion of reduced diameter with respect to the remainder of the body, a circular closure lid carried by the neck portion, anchor means on the closure lid, and a pull tab turnably movable on the anchor means. The anchor means is disposed off center or asymmetrically with respect to the circular closure lid. The pull tab has opposite ends, one of which constitutes a finger-engageable grip handle by which the user can raise this end, and the other of which constitutes a puncturing nose that is capable of rupturing a portion of the can lid when the first end of the pull tab is raised. In the storage condition of the can, the pull tab is disposed entirely within the confines of a peripheral groove on the lid, whereas prior to opening the can, the pull tab can be swung roughly one-half of a circle, about the anchor means, wherein the grip grip handle extends outwardly past this groove, so as to be readily grasped by the user. While disposed in this position, has its puncture nose overlying the area of weakness of the lid, to permit breakthrough of the area when the grip handle is lifted, and subsequently opening of the can. The advantage of the invention is that with a reduced size neck, and elongated pull tab, less aluminum is utilized than is the case with containers of existing design.

Specifically, as a consequence of the invention the outer diameter of a can lid can be reduced to approximately half of the outer diameter found on existing cans of current design. In other words, the surface area of the improved lid of the invention can be reduced by about 75%. This represents a cost saving for aluminum of \$3.00-\$5.00 per thousand lids, which converts to an annual cost savings of \$600 million to \$1 billion.

In a preferred environment, the stepped neck construction of FIG. 4 is to be utilized, and has been found to yield adequate strength without the need for switching to thicker wall aluminum for the side of the can.

Other features and advantages will hereinafter appear.

BRIEF DESCRIPTION OF THE DRAWINGS

In the accompanying drawings illustrating several embodiments of the invention.

DESCRIPTION OF THE PREFERRED EMBODIMENTS

Referring first to FIGS. 3, 4, 5*a*, 5*b*, 5*c* and 6, and in accordance with the present invention there is provided a novel and improved beverage container generally designated by the numeral 10, which is especially adapted for use with a container body style having a tubular configuration for a portion of its length, and a reduced neck diameter which enables a substantial savings in the quantity of metal or aluminum that is required for a particular volume of liquid in the container.

Figure 4:
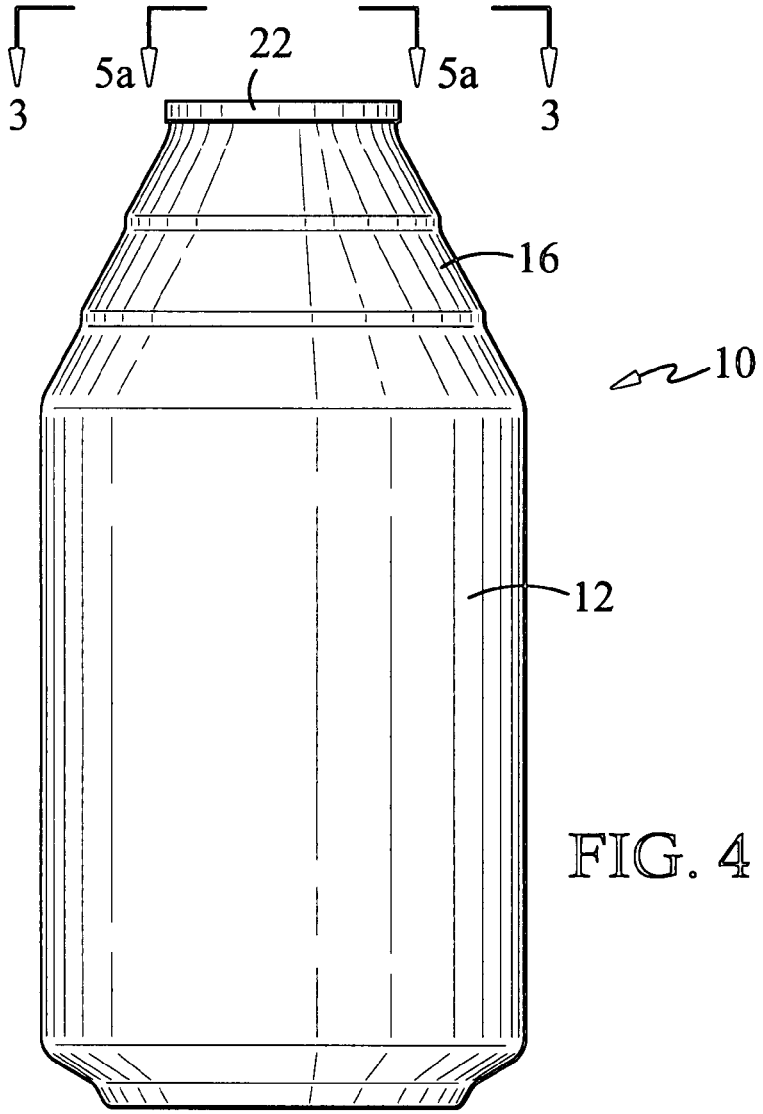
FIG. 4 is a front elevation of the improved beverage container of FIG. 3.
Figure 5A:
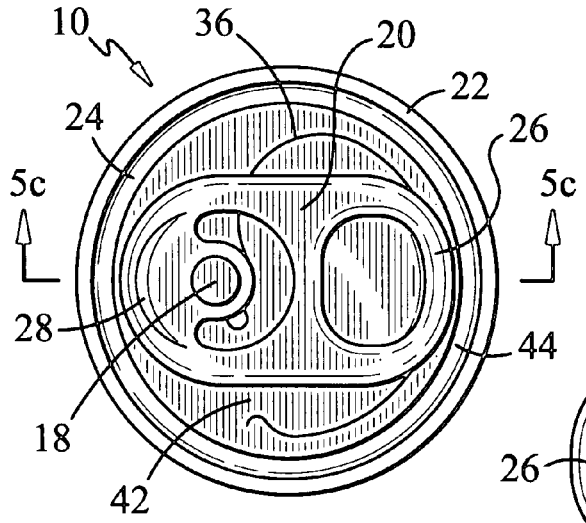
FIG. 5*a* is a top plan view of the closure lid per se, of the beverage can of the invention, showing a pull tab occupying a position thereon corresponding to storage, and prior to handling of the container for use. The view is taken on the line 5*a*—5*a* of FIG. 4.

FIG. 4 illustrates a container having a body 12 and rim 22. Preferably a stepped neck 16 is provided. By the invention, a novel and improved space-saving opening mechanism is provided on the container closure lid 14, FIG. 3, comprising an anchor means 18 and a pull tab 20. The anchor means is preferably formed as an upwardly extending stem on the closure lid, headed over as shown in FIG. 5*c*, to provide a leakproof seal of the closure lid. The lid 14 has a peripheral groove 24, extending completely around it. FIG. 5*c* illustrates the rim 22 as being a crimp connection between the container neck 16 and the closure lid 14. This crimp connection is air-tight, and thus also leak-proof. The pull tab 20 has a grip handle 26, and a puncture or puncturing nose 28, which overlies a portion of the closure lid 14 during storage of the container 10 and prior to its being used.

Figure 1:
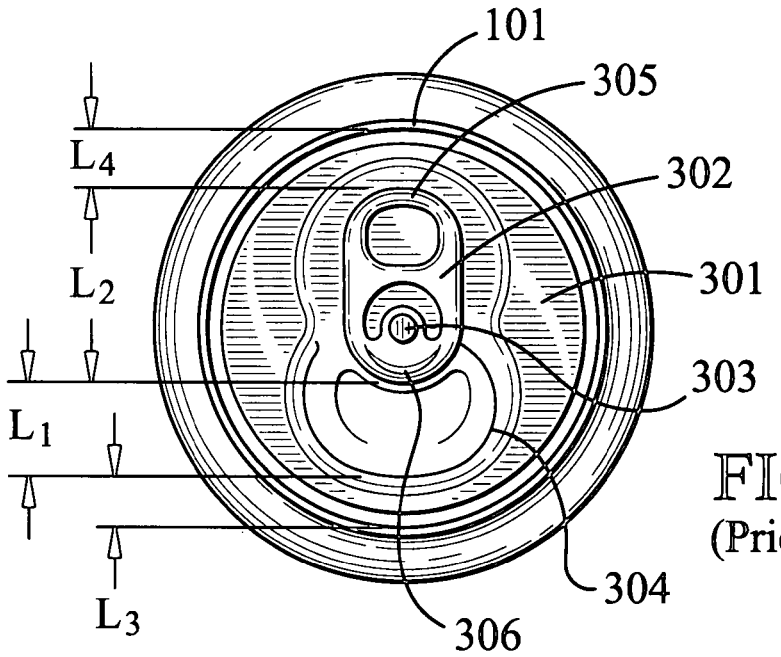
FIG. 1 (Prior Art)
FIG. 1 is a top plan view of a prior art container, illustrating a conventional closure lid having the usual pull tab mechanism anchored thereto, and showing a typical score area adapted to be ruptured when it is desired to open the container.
Figure 2:
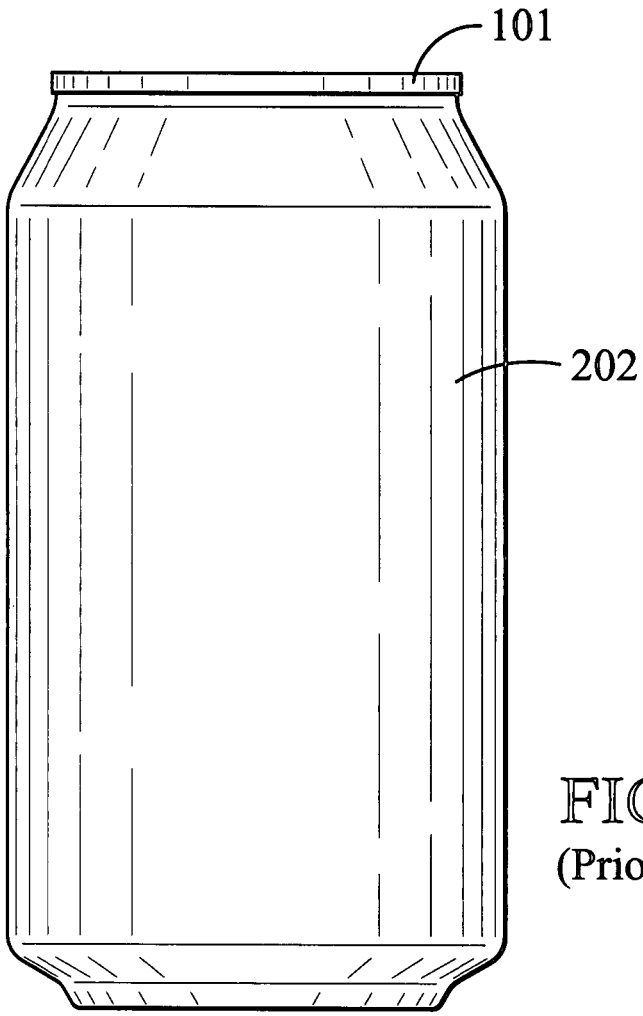
FIG. 2 (Prior Art)
FIG. 2 is a front elevation of the prior art container of FIG. 1, showing a rim in the form of a circumferential leak-proof crimp connection that joins the lid and can body.
Figure 3:
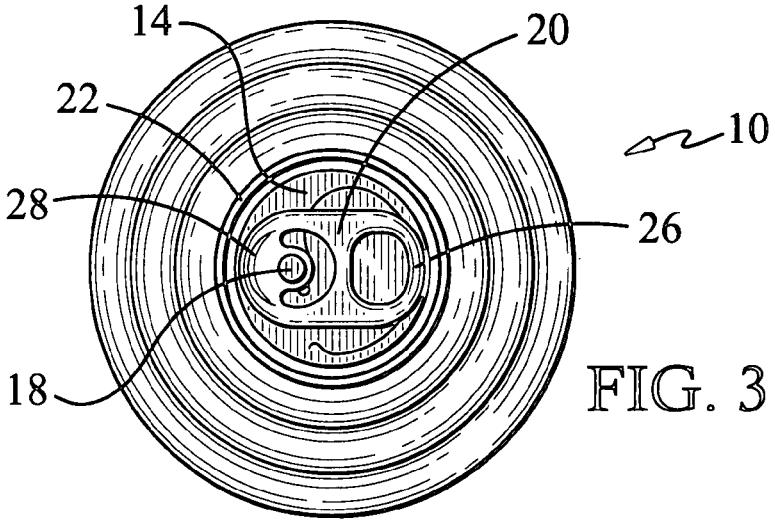
FIG. 3 is a top plan view of a new and improved beverage container embodying principles of the present invention, taken on the line 3—3 of FIG. 4.

By the invention, the anchor means 18 is disposed off-center or asymmetrically with respect to the closure lid 14. The hole 32 in the pull tab, FIG. 5*c*, receives the stem of the anchor means 18 with a snug fit. However, the fit is not so tight as to prevent the pull tab 20 from turning about the pivot provided by the anchor means 18, from a first, or nesting location shown particularly in FIG. 5*a*, to a second, or operational location illustrated in FIG. 5*b* and FIG. 6. In the first position and by the invention, the pull tab is as long as possible, and its puncture nose 28 lies closely adjacent to the inner diameter 44 of the peripheral groove 24 at the one location thereon, as in FIG. 5*c*. Similarly, the grip handle 26 of the long pull tab lies closely adjacent to the inner surface of the peripheral groove 24 at the other location thereon, which latter is diametrically disposed with respect to the first location, or stated differently, 180 degrees away therefrom. The pull tab 20 is of similar length as that of the pull tab 302 of conventional can lids, such as that of FIGS. 1 and 2.

FIG. 5*c* illustrates two recesses in the lid. Recess 34 provides a space for the fingernail of the user as he reaches through the grip handle's hole of the pull tab. As the grip handle is lifted, and assuming the pull tab is fairly rigid, the stem of the anchor means 18 acts as a fulcrum and pivots the undercurl formation of the nose 28 downward, toward the can lid. The second recess 30 is incorporated in order to provide a space to receive the undercurl of the nose 28 during the initial lifting of the pull tab. The recess is deep in its center, as in FIG. 5*c*, and becomes shallower at near its opposite ends, one of said ends being shown and designated 30*a*, eventually merging into the plane of the closure lid. By this arrangement, the force required to initially begin the lifting of the pull tab grip handle is reduced, since the undercurl can drop freely into the recess 30. As the pull tab is turned, the undercurl can merely ride up the recess part 30*a*, which latter is in the nature of a ramp. This construction renders the pull tab easier to manipulate initially, as can now be readily understood.

Figure 5B:
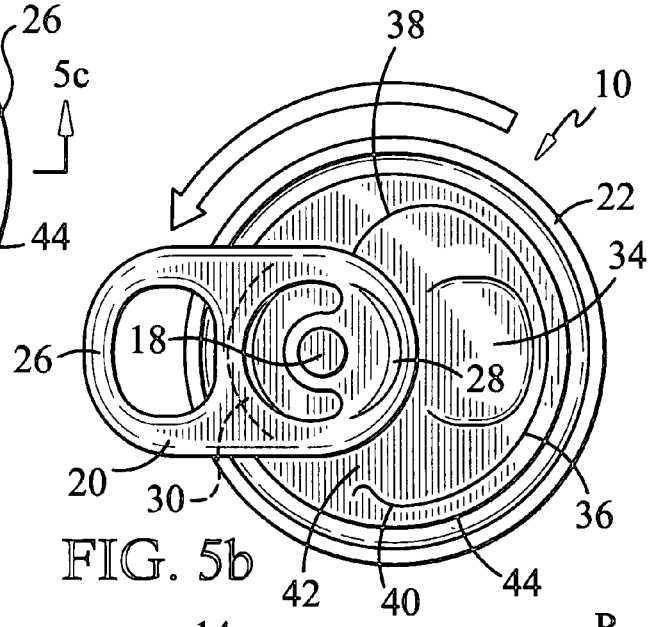
FIG. 5*b* is a top plan view of the closure lid per se of the improved beverage can of FIG. 5*a*, illustrating the pull tab as having been shifted 180 degrees from the position of FIG. 5*a*, in readiness for opening of the can by the consumer.
Figure 5C:
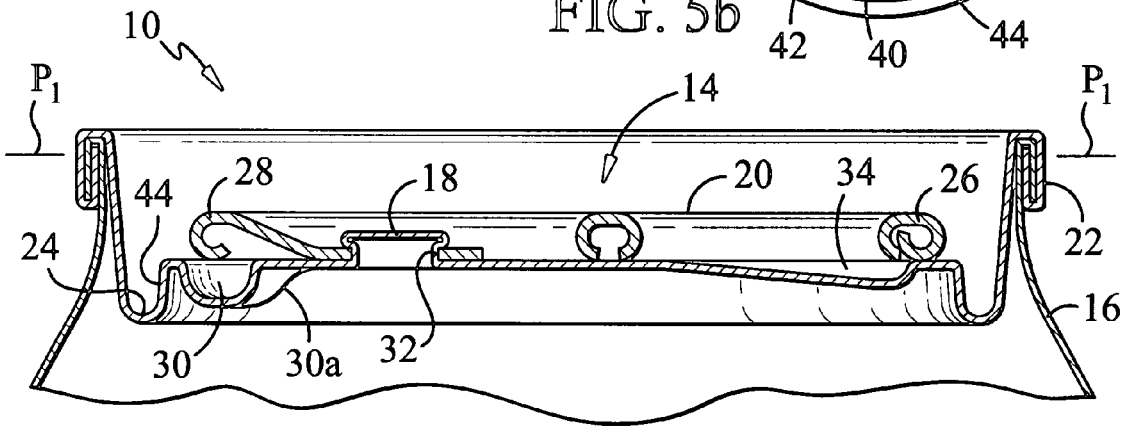
FIG. 5*c* is a fragmentary axial section taken on the line 5*c*—5*c* of FIG. 5*a*.
Figure 6:
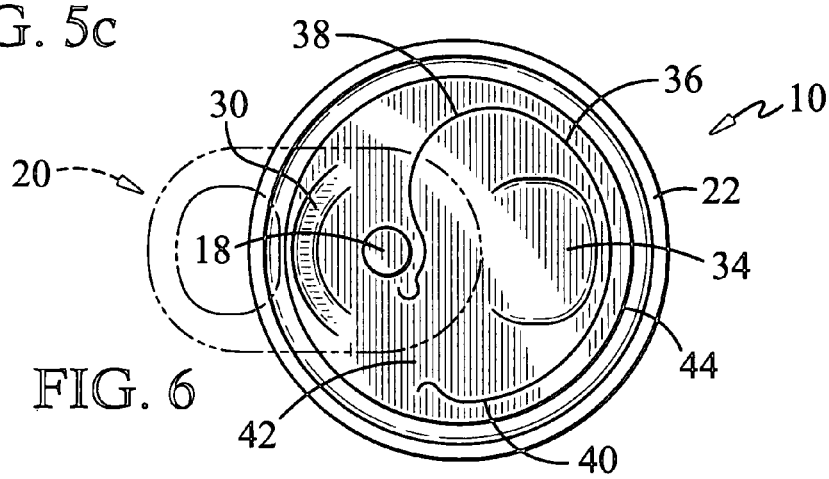
FIG. 6 is a top plan view similar to FIG. 5*b*, except showing the pull tab in phantom, to illustrate the configuration of the remainder of the closure lid.

Referring now to FIGS. 5*b* and 6, there is illustrated a view showing the pull tab 20 as having been swung by the consumer to the second position, from the first position, wherein the grip handle 26 now overlies both the stepped neck 16 and the side of the can body. Such an arrangement enables the consumer to readily grasp the pull tab 20 by its grip handle 26 and pry upwards. Thus the pull tab 20, being stiff as noted above, is pivoted about the anchor means stem 18, and the puncture nose 28 of the pull tab 20 breaks through the closure lid 14 along a score line 36 thereon. The score line 36 has a beginning 38 and an end 40. Adjacent the end 40 is a hinge formation 42, by which the resultant cutout defined by the score line 36 is held captive with the closure lid 14, and merely yields downwardly into the can interior.

This has two advantages. First, no part of the opening mechanism separates from the can, thus eliminating loose pull tabs, and thereby giving rise to reduced litter and a resultant cleaner environment. Next, since the mechanism remains with the can, it is automatically recycled therewith when the can is returned to an appropriate recycling center.

Also it is to be noted that in the storage position of FIGS. 5*a* and 5*c*, all parts of the pull tab 20 lie completely below a plane P1 defined by the rim 22. Also, the pull tab does not extend past the rim 22. Instead, the parts 26 and 28 of the pull tab 20 lie closely adjacent to the inner diameter wall 44 of the peripheral groove 24. By this construction, closure lid 14 can have a relatively smaller diameter compared to corresponding parts of existing containers. Also, since there is no interference from upstanding parts of the pull tab 20, the disclosed arrangement avoids possible jamming when being handled by automatic equipment. The problem noted above, with cans known as 'rockers', is completely circumvented.

Accordingly, it is believed that the arrangement just described constitutes a breakthrough in the container field, since considerably less aluminum is required by virtue of the reduced closure lid diameter, and at the same time, no compromise in convenience is introduced as far as the consumer is concerned, since a simple twist and lift operation is all that is required to open the container.

Figure 7A:
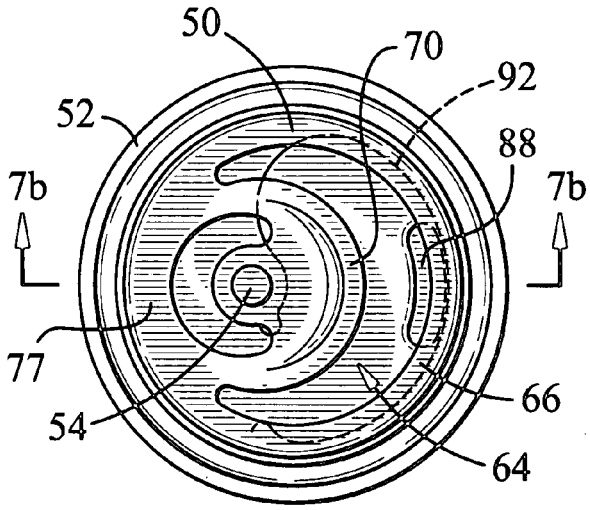
FIG. 7*a* is a top plan view of a modified closure lid per se, and illustrating a modified pull tab configuration for use with the container of FIG. 4.
Figure 7B:
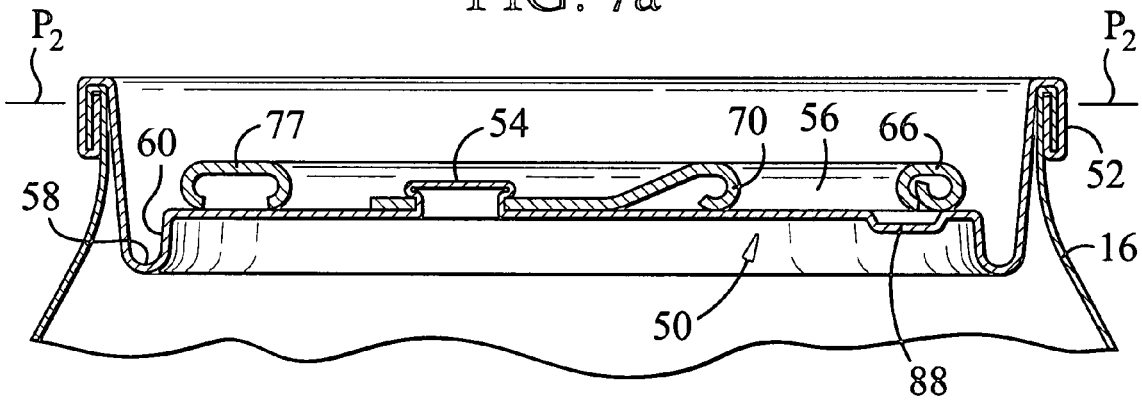
FIG. 7*b* is an axial section taken on the line 7*b*—7*b* of FIG. 7*a*.
Figure 8:
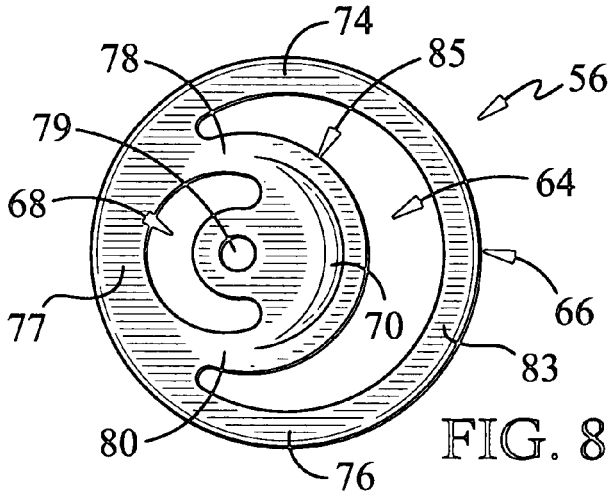
FIG. 8 is a plan view of the pull tab component of FIGS. 7*a* and 7*b*, and further illustrating its construction.

Another embodiment of the invention is shown in FIGS. 7*a*, 7*b*, 8, and 9*a*-9*d*. As in the previous embodiment, the arrangement is preferably applicable to containers having reduced neck size, and of a configuration similar to that shown in FIGS. 4 or 14. Referring to FIGS. 7*a* and 7*b*, the container's reduced neck 16 is connected in both mechanical and sealing relation to a closure lid 50 by means of the usual crimp. The crimp has an outer surface, constituting a rim 52, and the rim 52 lies in a horizontal plane P2. All parts of the opening mechanism to be described are disposed below said plane P2 and rim 52. As in the first embodiment, the closure lid 50 has an anchor means 54 which is disposed off center with respect to a pull tab, designated 56. The latter can be of generally circular shape as shown in FIG. 8, normally overlying the container closure lid 50 in the storage position of FIGS. 7*a* and 7*b*, and prior to use.

The closure lid 50 has a peripheral groove 58 with an outer diameter (no number) and an inner diameter 60. As shown, maximum use is made of the reduced area of the closure lid 50 by virtue of having the pull tab 56 formed as shown. The periphery of the tab 56 is disposed closely adjacent to the inner diameter 60 of the peripheral groove 58 in the lid. In contrast to the first embodiment, a sliding or turnable connection between the pull tab 56 and the anchor means 54 is not necessary.

Referring to FIG. 8, the pull tab 56 has a first crescent shaped cutout 64 which is defined by a grip handle 66 of the pull tab 56, and a second crescent shaped cutout 68 which faces the first. Adjacent the second cutout is an anchor hole 79 that receives the anchor means 54 of the lid. Taken together, the two cutouts 64, 68 surround the location of the anchor hole 79. The pull tab 56 has a metal base strip 83 and a pair of substantially divergent metal strips 74, 76 which are integral with the base strip 83 and integral with one another. The pull tab 56 also has a puncturing nose 70. In the first or normal position of FIGS. 7*a* and 7*b*, the pull tab 56 lies substantially flat on the closure lid 50. Connecting the grip handle 66 to the puncturing nose 70 are the above noted metal strips 74, 76 and intermediate connector strips 78, 80, respectively, as well as a connector strip 77, FIG. 8. These strips transmit force that is applied by the grip handle 66 to the puncturing nose 70. The strips 78, 80 and puncturing nose 70 together define a metal yoke portion 85 of the pull tab, which yoke portion joins the non-adjacent regions of the metal strips 74, 76, and holds them in fixed relation. The anchor hole 79 is disposed in this yoke portion 85, as shown in FIG. 8. With such an arrangement, the puncturing nose 70 is disposed between the hole 79 (which is affixed to the anchor means 54 of the lid), and the base strip 83 of the grip handle 66.

In FIG. 7*b*, the pull tab 56 is flat, and lies completely below the plane P2 of the rim 52. In addition, with respect to FIG. 7*b*, all parts of the pull tab 56 lie within the inner diameter 60 of the peripheral groove 58, as in the previous arrangement.

Figure 9A:
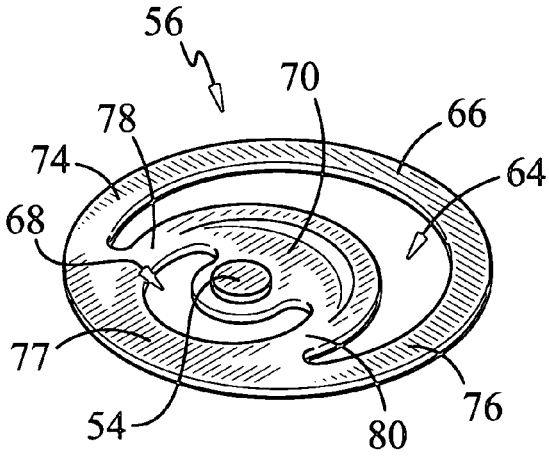
FIG. 9*a* is a perspective view of the pull tab of FIG. 8 per se, shown flat, in the position it occupies on the closure lid.
Figure 9B:
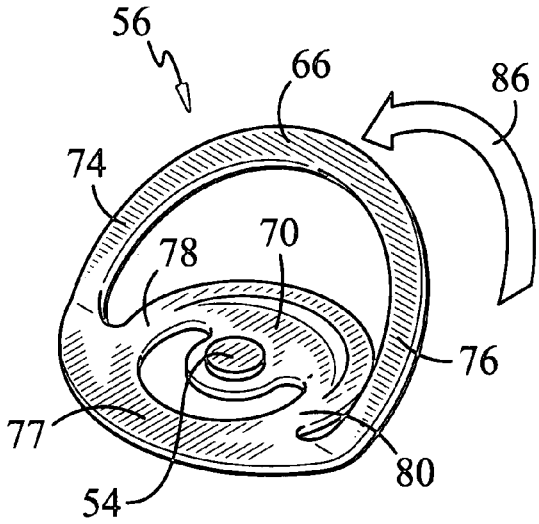
FIG. 9*b* is another perspective view like FIG. 9*a*, except illustrating the initial movement of part of the pull tab per se, in readiness for opening the container.
Figure 9C:
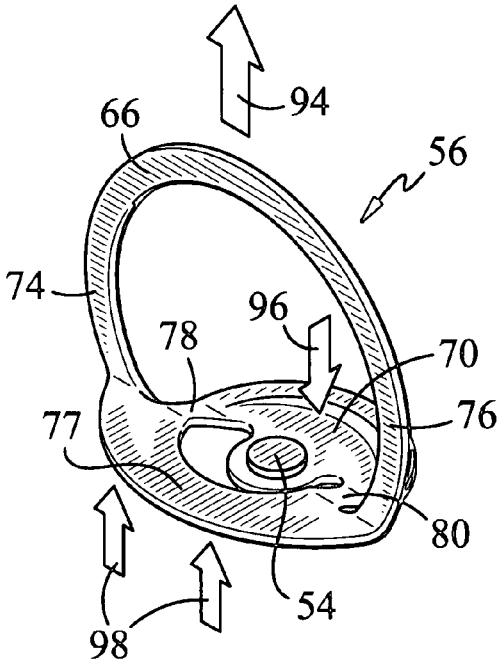
FIG. 9*c* is still another perspective view, illustrating the subsequent movement of the pull tab per se, just prior to opening of the container.
Figure 9D:
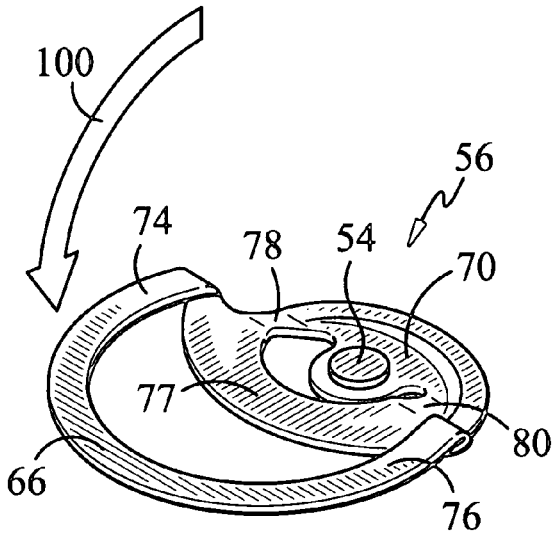
FIG. 9*d* is yet another perspective view, and illustrating the final configuration of the pull tab per se, after the container has been opened.

The opening sequence is illustrated progressively in FIGS. 9*a*-9*d*, respectively. In FIG. 9*b*, there is illustrated the position of the grip handle 66 as it is initially lifted by the consumer. The large arrow 86 shows the direction of the force exerted by him. A recess 88, FIGS. 7*a* and 7*b*, in the closure lid 50 enables the user to insert his fingernail under the grip handle 66 through the crescent shaped cutout 64. FIG. 9*c* shows a further step, wherein the grip handle 66 has been raised to a vertical position, and the pivoting action of the anchor means 54 forces the puncturing nose 70 to break through the closure lid 50 at the score line 92, FIG. 7*a*. Finally, the grip handle 66 can be pulled back completely on itself as in FIG. 9*d*, such that it is out of the way of the opening formed by the broken score line 92, FIG. 7*a*.

In FIG. 9*c*, the arrow 94 indicates the continual force applied to the grip handle 66, whereas the arrow 96 illustrates the force of the puncturing nose 70 on the area of weakness on the closure lid 50, defined by the score line 92. Arrows 98 show the force applied by the strips 74, 76 respectively, and arrow 100 shows the direction of the force applied by the user as he bends back the grip handle 66 fully, in FIG. 9*d*.

Figure 10:
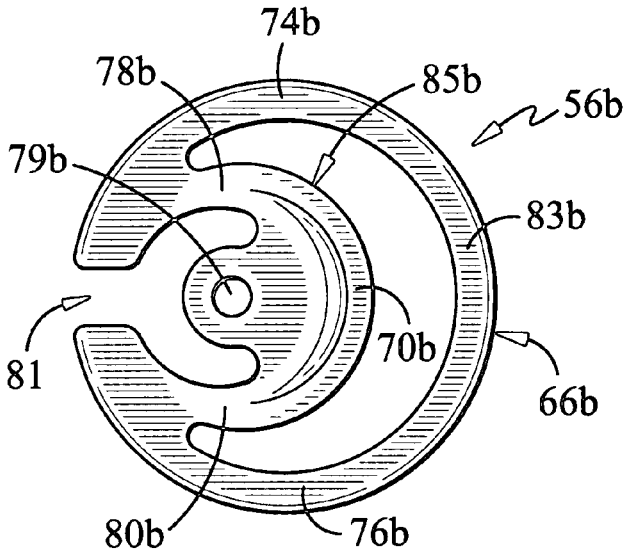
FIG. 10 is a plan view of a modified pull tab for use with the beverage container of FIG. 4 or alternately with the container of FIG. 14.

Another embodiment of the invention is shown in FIG. 10, wherein reference numerals with the suffix 'b' have been added to parts of the construction corresponding to the embodiment of FIGS. 7*a*, 7*b* and 8. In particular, the pull tab 56*b* includes a grip handle 66*b* that comprises a metal base strip 83*b* to which there are connected divergent metal strips 74*b* and 76*b*. The remote ends of these latter strips are connected by additional strips 78*b* and 80*b*, constituting a yoke portion 85*b* of the pull tab 56*b*. The yoke portion 85*b* further includes a puncturing nose 70*b* and an anchor hole 79*b*, as in the previous instance. In place of the strip 77 of FIG. 8, there is provided a slot 81 in the pull tab. Functioning of this embodiment is believed to be comparable to that of the prior embodiment, as to the opening steps which were outlined previously.

Figure 11:
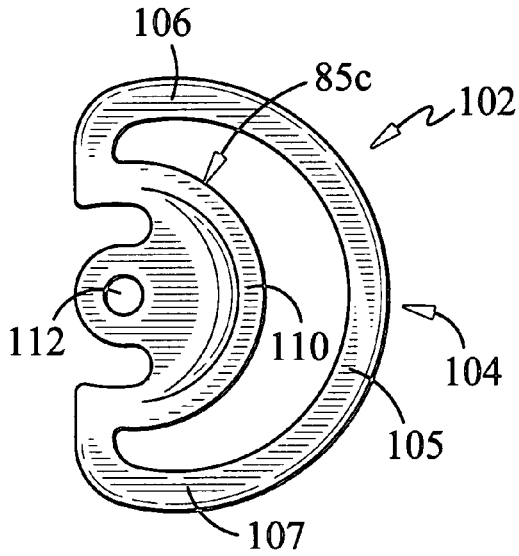
FIG. 11 is a plan view of a further modified pull tab for use with the containers of FIGS. 4 or 14.

Yet another embodiment of the invention is shown in FIG. 11. The pull tab 102 is seen to include a grip handle 104 comprising a central metal strip 105, and divergent strips 106 and 107 integral with the metal strip 105. Again, there is provided a yoke portion 85*c* comprising a puncturing nose 110 and anchor hole 112. The yoke portion 85*c* holds the ends of the strips 106 and 107 together and in fixed relation with respect to one another, prior to opening of the can. The opening sequence is considered to be similar to that of the previously described embodiments.

Figure 12:
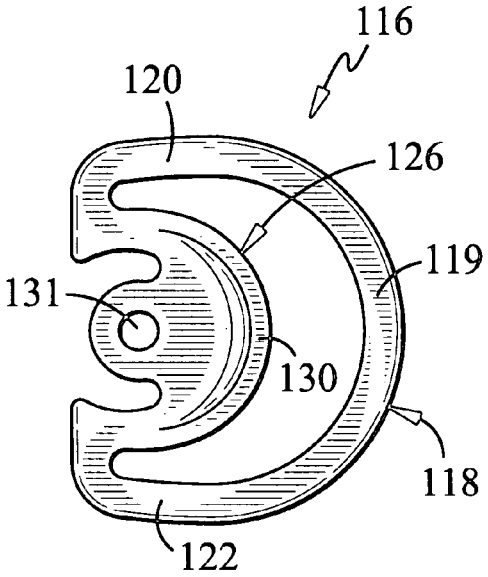
FIG. 12 is a plan view of a still further modified pull tab for use with the containers of FIGS. 4 or 14.
Figure 13:
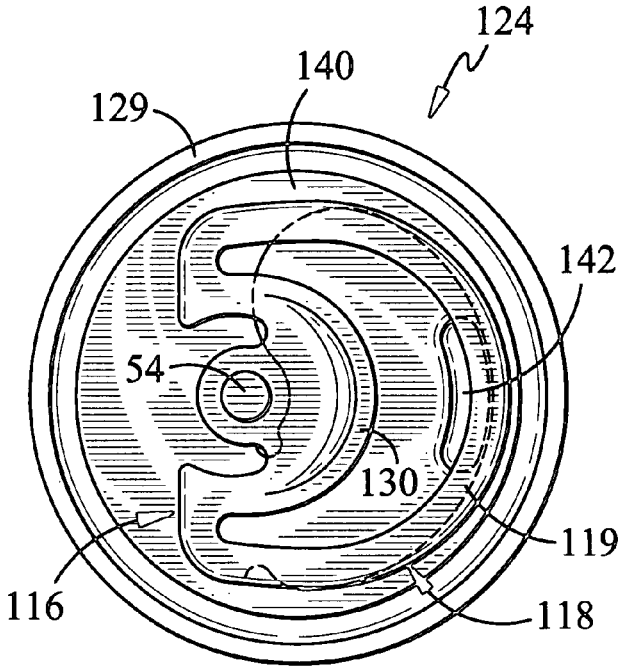
FIG. 13 is a top plan view of the pull tab of FIG. 12, as it appears when secured in position on the top of one of the containers of FIGS. 4 or 14.

Still another embodiment of the invention is shown in FIGS. 12 and 13. FIG. 12 illustrates a modified pull tab 116, having a grip handle 118 constituted as a central metal strip 119, and a pair of divergent metal strips 120, 122 that are integral with the central metal strip 119. A yoke portion 126 is provided, connecting the non-adjacent ends of the divergent strips 120, 122. The yoke portion 126 comprises a puncturing nose 130 and a hole 131 for the anchor means 54 of the can lid.

In FIG. 13, the can closure lid is designated 140. A small recess 142 underlies the central metal strip 119 of the grip handle 118, as in the embodiment of FIG. 7, indicated in that figure by the reference numeral 88.

Figure 14:
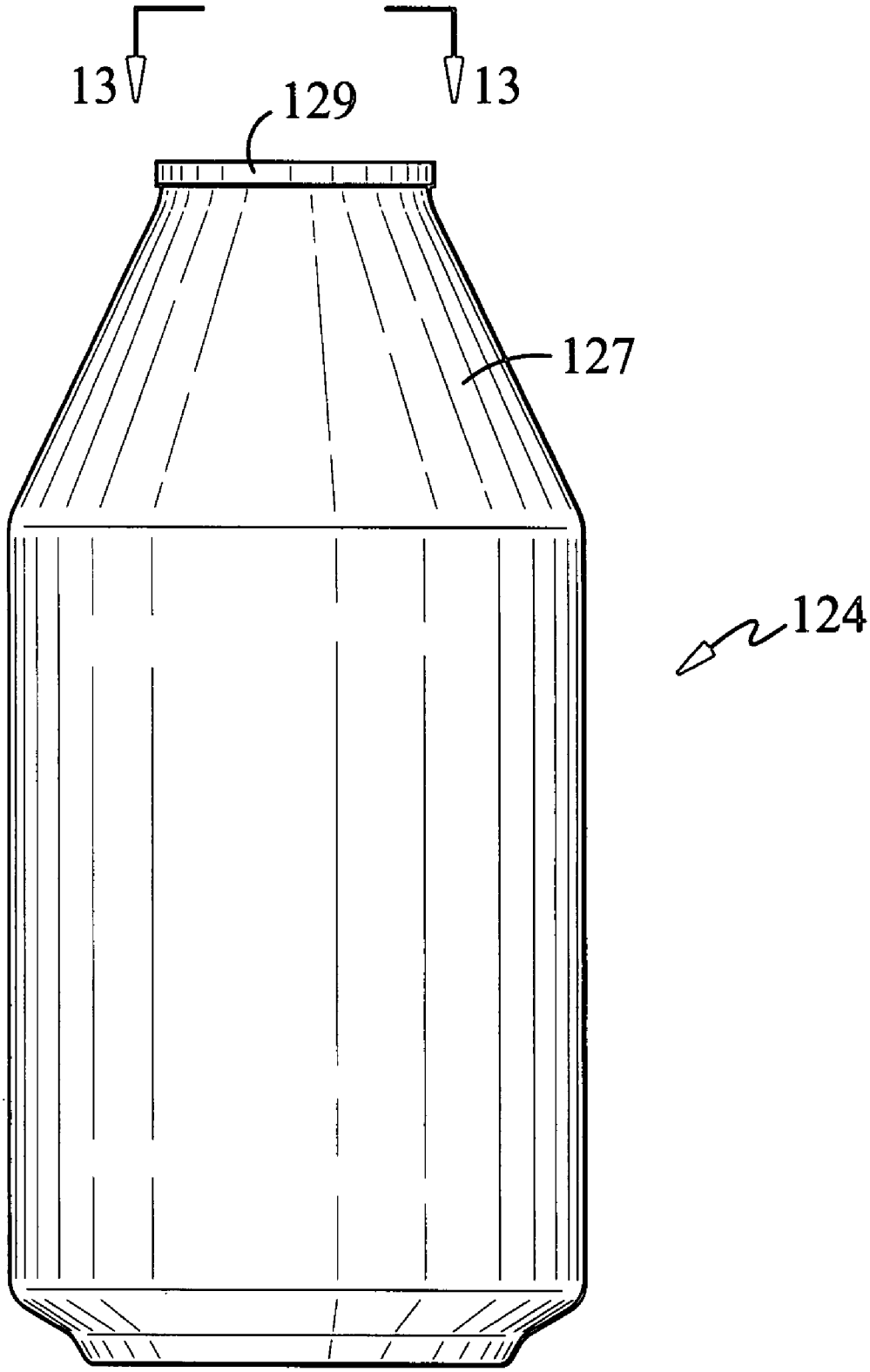
FIG. 14 is a front elevation of a modified beverage container for optional use with the various pull tabs to be described hereinbelow.

In connection with the embodiments of the added forms of pull tab shown respectively in FIGS. 10, 11 and 12, it is intended that the pull tab structures therein be capable of being utilized with the reduced-diameter lid of a beverage can of the type shown in either FIG. 4, in particular having a stepped neck, or a can of the type shown in FIG. 14 and designated 124, where the neck 127 is of non-uniform width, and has a gradual taper. The rim of the can in FIG. 14 is designated 129.

It is understood that adaptive neck structures between a can body and a lid are not intended to be restricted to those shown. On the contrary, other shapes of beverage cans could be utilized, with equally good results. Those configurations depicted in the present set of drawings are considered to be illustrative only.

In summary, the can lid outer diameter can be reduced by approximately half of the current outer diameter. Hence the surface area of the lid can be reduced by about 75%. Also, by virtue of the reduced lid diameter, a lighter gauge aluminum sheet stock can be utilized for its fabrication. The net result represents a cost saving of aluminum of $3.00-$5.00 per thousand lids, or an annular savings of from $600 million to $1 billion.

The retention of the respective pull tab 20, 56, 102 or 116, at all times by the closure lid 14, 50 or 140 respectively, circumvents problems with loss of the pull tab, which might otherwise fall on the ground and possibly constitute a hazard to personnel inadvertently stepping on it and suffering a cut foot or toe. Furthermore, since the pull tab is held captive even after use of the container, recycling of the pull tab is automatic, as when the can is returned to an appropriate store or recycling center.

From the above it can be seen that I have provided novel and improved beverage containers that are both simple in their structure, reliable in operation, and which result in a substantial reduction in the amount of aluminum required, with its attendant cost.

The opening mechanisms are largely self-explanatory, and thus no confusion results on the part of the user.

The disclosed arrangements are thus seen to represent a distinct advance and improvement in the field of liquid containers.

Each and every one of the appended claims defines an aspect of the invention which is separate and distinct from all others, and accordingly it is intended that each claim be treated as such in any determination of novelty or validity.

Variations and modification are possible without departing from the spirit of the invention, and portions of the improvement may be used without others.

LIST OF REFERENCE NUMERALS

10, 124 Beverage container
12 Container body
14, 50, 140 Closure lid
16 Stepped neck
18, 54 Anchor means or anchor stem
20, 56, 56*b*, 102, 116 Pull tab
22, 52 Outer periphery of lid, or rim
24, 58 Peripheral groove in lid
26, 66, 66*b*, 104, 118 Grip handle
28, 70, 70*b*, 110, 130 Puncturing nose
30 Recess in lid
30*a* End of recess 30
32, 79, 79*b*, 112, 131 Anchor hole in pull tab
34 Arcuate recess in lid
34*a* Trailing portion of arcuate recess 34
36, 92 Score line
38 Beginning of score line
40 End of score line
42 Hinge formation
22, 52, 129 Outer periphery of lid
44, 60 Inner diameter of peripheral groove
64 Crescent shaped cutout
68 Crescent shaped cutout
74, 74*b*, 106, 120 Strip
76, 76*b*, 107, 122 Strip
77 Connector strip
78, 78*b* Strip
80, 80*b* Strip
81 Slot
83, 83*b*, 105, 119 Metal base strip
85, 85*b*, 85*c*, 126 Yoke portion
86 Arrow
88, 142 Recess
94 Arrow
96 Arrow
98 Arrows
100 Arrow
106, 107 Divergent metal strip
120, 122 Divergent metal strip
127 Smooth, tapered neck of beverage can
101 Prior art, can rim construction
202 Prior art, can side wall construction
301 Prior art, can lid
302 Prior art, pull tab
303 Prior art, anchor
304 Prior art, score line
305 Prior art, end of pull tab
306 Prior art, nose or front of pull tab

What is claimed is:

1. A beverage container, comprising in combination:

a) a tubular can body having a side wall, b) said tubular body further having a neck portion of reduced diameter with respect to said side wall, c) a closure lid secured to the uppermost portion of said side wall, said closure lid having a score line defining an area of weakness, d) said closure lid having an anchor stem thereon, and e) a pull tab on said anchor stem of the closure lid, f) said pull tab further having a pair of spaced-apart substantially crescent-shaped cutouts, g) said crescent-shaped cutouts being disposed on opposite sides of said anchor stem and generally facing one another, h) said closure lid further having a peripheral groove, and i) said pull tab further having a generally oval configuration with peripheral portions thereof lying adjacent to and radially inside said peripheral lid groove, j) said pull tab having a puncturing nose, said puncturing nose being disposed between the pull tab and the anchor stem, said puncturing nose further being adapted to break through said area of weakness when force is applied to the pull tab, thereby to open the can.

* * * * *